US009707690B2

(12) United States Patent
Hodgson

(10) Patent No.: US 9,707,690 B2
(45) Date of Patent: Jul. 18, 2017

(54) HEATED SHAVING RAZOR HANDLE

(71) Applicant: The Gillette Company, Boston, MA (US)

(72) Inventor: Matthew James Hodgson, Reading (GB)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 14/540,300

(22) Filed: Nov. 13, 2014

(65) Prior Publication Data

US 2015/0174774 A1 Jun. 25, 2015

Related U.S. Application Data

(60) Provisional application No. 61/918,901, filed on Dec. 20, 2013.

(51) Int. Cl.

| | |
|---|---|
| ***B26B 21/48*** | (2006.01) |
| ***B26B 21/52*** | (2006.01) |
| ***B26B 21/10*** | (2006.01) |
| ***B26B 21/14*** | (2006.01) |
| ***B26B 21/22*** | (2006.01) |
| ***B26B 21/40*** | (2006.01) |

(52) U.S. Cl.

CPC ..... *B26B 21/48* (2013.01); *B26B 21/14* (2013.01); *B26B 21/225* (2013.01); *B26B 21/4018* (2013.01); *B26B 21/521* (2013.01); *B26B 21/526* (2013.01)

(58) Field of Classification Search

CPC ..... B26B 21/48; B26B 21/222; B26B 21/225; B26B 21/227; B26B 21/521; B26B 21/4012; B26B 19/048

USPC ..... 30/527, 532, 34.2, 140, 34.05, 74

See application file for complete search history.

(56) References Cited

U.S. PATENT DOCUMENTS

| | | |
|---|---|---|
| 1,505,578 A | 8/1924 | Barra |
| 1,552,026 A | 9/1925 | Barra |

(Continued)

FOREIGN PATENT DOCUMENTS

| | | |
|---|---|---|
| DE | 575 523 | 4/1933 |
| DE | 28 01 845 | 7/1979 |

(Continued)

OTHER PUBLICATIONS

FR 2703290 english translation; Claude Mendola; Oct. 7, 1994.*

(Continued)

*Primary Examiner* — Laura M Lee

(74) *Attorney, Agent, or Firm* — John M. Lipchitz; Kevin C. Johnson; Steven W. Miller

(57) ABSTRACT

A shaving razor system with a handle having an elongated gripping portion with a proximal end portion and a distal end portion. A connection base is mounted to the proximal end portion of the handle. A heater bar is operably connected to a power source positioned within the handle. The heater bar is joined to the connection base. A removable razor cartridge having a housing with a guard, a cap and at least one blade mounted to the housing between the guard and the cap. An interconnect member fixed to the housing and having a handle mounting surface releasably engaged with a corresponding surface on the connection base.

10 Claims, 9 Drawing Sheets

(56) References Cited

U.S. PATENT DOCUMENTS

| | | | | |
|---|---|---|---|---|
| 1,821,574 | A | | 9/1931 | Peters |
| 2,018,147 | A | | 10/1935 | Pirwitz |
| 2,063,808 | A | | 12/1936 | Henderson et al. |
| 2,164,581 | A | | 7/1939 | Ewald |
| 2,225,257 | A | | 12/1940 | Conill |
| 2,231,219 | A | | 2/1941 | Peterson |
| 2,324,148 | A | | 7/1943 | Gravin |
| 2,327,192 | A | | 8/1943 | Keene |
| 2,414,482 | A | | 1/1947 | Norman |
| 2,622,319 | A | | 12/1952 | Hunt |
| 2,714,651 | A | | 8/1955 | Wotton |
| 3,364,568 | A | | 1/1968 | Lowy |
| 3,454,745 | A | | 7/1969 | Stone |
| 3,611,568 | A | | 10/1971 | Alexander et al. |
| 3,648,368 | A | | 3/1972 | Douglass et al. |
| 3,896,364 | A | | 7/1975 | Reister |
| 3,934,115 | A | | 1/1976 | Peterson |
| 4,077,119 | A | | 3/1978 | Sellera |
| 4,253,013 | A | | 2/1981 | Mabuchi |
| 4,377,034 | A | | 3/1983 | Druash et al. |
| 4,403,414 | A | * | 9/1983 | Kiraly ..... B26B 21/225 30/531 |
| 4,598,192 | A | | 7/1986 | Garrett |
| 4,716,652 | A | | 1/1988 | Cataudella |
| 4,809,432 | A | | 3/1989 | Schauble |
| 4,864,735 | A | | 9/1989 | Chung |
| 4,918,818 | A | | 4/1990 | Hsieh |
| 5,010,905 | A | | 4/1991 | Snyder et al. |
| 5,046,249 | A | | 9/1991 | Kawara et al. |
| 5,098,414 | A | | 3/1992 | Walker |
| 5,113,585 | A | | 5/1992 | Rogers et al. |
| 5,121,541 | A | | 6/1992 | Patrakis |
| 5,191,712 | A | | 3/1993 | Crook et al. |
| 5,299,354 | A | | 4/1994 | Metcalf et al. |
| 5,337,478 | A | | 8/1994 | Cohen et al. |
| 5,394,777 | A | | 3/1995 | Kozikowski |
| 5,402,573 | A | | 4/1995 | Laniado |
| 5,454,164 | A | | 10/1995 | Yin et al. |
| 5,653,025 | A | | 8/1997 | Cheng et al. |
| 5,780,819 | A | | 7/1998 | Fabrikant et al. |
| 5,782,346 | A | | 7/1998 | Gray et al. |
| 5,786,573 | A | | 7/1998 | Fabrikant et al. |
| 5,794,342 | A | | 8/1998 | Davey |
| 6,158,125 | A | | 12/2000 | Dolev |
| 6,301,792 | B1 | | 10/2001 | Speer |
| 6,421,918 | B1 | | 7/2002 | Dato et al. |
| 6,430,813 | B2 | | 8/2002 | Muraguchi et al. |
| 6,481,104 | B1 | | 11/2002 | Parker et al. |
| 6,574,866 | B2 | | 6/2003 | Pragt et al. |
| 6,763,590 | B2 | | 7/2004 | Guimont et al. |
| 6,789,321 | B2 | | 9/2004 | Simms |
| 6,836,966 | B2 | | 1/2005 | Patrick |
| 6,868,610 | B2 | | 3/2005 | Brandt et al. |
| 6,910,274 | B1 | | 6/2005 | Pennella et al. |
| 6,946,624 | B1 | | 9/2005 | Tomassetti |
| 7,137,203 | B2 | | 11/2006 | Bressler et al. |
| 7,520,408 | B1 | | 4/2009 | Smith et al. |
| 8,479,624 | B2 | | 7/2013 | Flyash et al. |
| 8,510,958 | B2 | | 8/2013 | Hart et al. |
| 8,516,706 | B2 | | 8/2013 | Flyash et al. |
| 2001/0003869 | A1 | | 6/2001 | Rocha |
| 2001/0023538 | A1 | | 9/2001 | Muraguchi et al. |
| 2002/0096512 | A1 | | 7/2002 | Abbott et al. |
| 2002/0189102 | A1 | | 12/2002 | Orloff |
| 2003/0046816 | A1 | | 3/2003 | Kanzer |
| 2003/0088984 | A1 | | 5/2003 | Brandt et al. |
| 2003/0101589 | A1 | | 6/2003 | Barish |
| 2003/0154832 | A1 | | 8/2003 | Guimont et al. |
| 2003/0155887 | A1 | | 8/2003 | Bourilkov et al. |
| 2003/0226258 | A1 | | 12/2003 | Patrick |
| 2003/0231001 | A1 | | 12/2003 | Bruning |
| 2004/0045948 | A1 | | 3/2004 | Shalev et al. |
| 2004/0074097 | A1 | | 4/2004 | Guimont et al. |
| 2005/0268472 | A1 | | 12/2005 | Bourilkov et al. |
| 2006/0070242 | A1 | | 4/2006 | Szczepanowski et al. |
| 2006/0123631 | A1 | * | 6/2006 | Szczepanowski .... B26B 21/225 30/44 |
| 2010/0031510 | A1 | | 2/2010 | Gester et al. |
| 2011/0126413 | A1 | | 6/2011 | Szczepanowski et al. |
| 2011/0167640 | A1 | | 7/2011 | Flyash et al. |
| 2012/0233864 | A1 | | 9/2012 | Flyash et al. |
| 2012/0255185 | A1 | * | 10/2012 | Patel ..... B26B 21/4093 30/527 |
| 2012/0266465 | A1 | | 10/2012 | Hart et al. |
| 2012/0279070 | A1 | | 11/2012 | Seo |

FOREIGN PATENT DOCUMENTS

| | | | |
|---|---|---|---|
| FR | 520234 | 6/1921 | |
| FR | 749861 | 8/1933 | |
| FR | 840502 | 4/1939 | |
| FR | 985030 | 7/1951 | |
| FR | 2703290 | * 10/1994 | ..... B26B 21/48 |
| FR | 2716402 | 8/1995 | |
| GB | 541723 | 12/1941 | |
| GB | 1075139 | 7/1967 | |
| GB | 2452411 | 5/2010 | |
| JP | 56128188 | 10/1981 | |
| WO | WO 92/13684 | 7/1992 | |
| WO | WO 94/04106 | 3/1994 | |
| WO | WO 97/08804 | 3/1997 | |

OTHER PUBLICATIONS

FR2716402 English Translation; Des Garets; Aug. 25, 1995.*
U.S. Appl. No. 14/540,067, filed Nov. 13, 2014, Matthew James Hodgson.
PCT International Search Report with Written Opinion in corresponding int'l appln. PCT/US2014/067526 dated Feb. 18, 2015.

* cited by examiner

HEATED SHAVING RAZOR HANDLE

FIELD OF THE INVENTION

The present invention relates to shaving razors and razor cartridges, and more particularly to heated shaving razor handles for wet shaving.

BACKGROUND OF THE INVENTION

Users of wet-shave razors generally appreciate a feeling of warmth against their skin during shaving. The warmth feels good, resulting in a more comfortable shave. For example, barbershops typically wrap the client's face in a warm towel and apply heated shaving cream to the face prior to shaving. Various attempts have been made to provide products that deliver a warm feeling during the shaving process. For example, shaving creams have been formulated to react exothermically upon release from the shaving canister, so that the shaving cream imparts warmth to the skin. Also, razor heads have been heated using hot air, heating elements, and linearly scanned laser beams, with power being supplied by a power source such as a battery. Razor blades within a razor cartridge have also been heated. The drawback with heated blades is they have minimal surface area in contact with the user's skin. This minimal skin contact area provides a relatively inefficient mechanism for heating the user's skin during shaving. There is a need to provide a razor capable of delivering improved heating capability to the user during shaving.

SUMMARY OF THE INVENTION

In one aspect, the invention features, in general, a simple, efficient shaving razor system having a handle with an elongated gripping portion with a proximal end portion and a distal end portion. A connection base is mounted to the proximal end portion of the handle, a heater bar is operably connected to a power source and positioned within the handle. The heater bar is joined to the connection base. A removable razor cartridge is provided having a housing with a skin engaging member, a cap and at least one blade mounted to the housing between the skin engaging member and the cap. An interconnect member is fixed to the housing having a handle mounting surface releasably engaged with a corresponding surface on the connection base.

In one aspect, the invention features, in general, a simple, efficient shaving razor handle for applying heat with an elongated gripping portion having a proximal end portion and a distal end, portion. A connection base is pivotably mounted to the proximal end of the handle. A power source is positioned within the elongated gripping portion. A heater bar is operably connected to the power source for delivering heat during a shaving stroke. The heater bar is joined to the connection base. The connection base has a housing mounting surface for retaining a removable razor cartridge.

If, desired, particular embodiments may optionally include the heater bar having an elongated portion extending generally transverse to the elongated gripping portion and a pair of opposing lateral end portions that extend generally transverse from the elongated portion and away from the elongated gripping portion. Particular embodiments may also optionally include the heater bar having a recessed surface.

The details of one or more embodiments of the invention are set forth in the accompanying drawings and the description below. It is understood that certain embodiments may combine elements or components of the invention, which are disclosed in general, but not expressly exemplified or claimed in combination, unless otherwise stated herein. Other features and advantages of the invention will be apparent from the description and drawings, and from the claims.

DETAILED DESCRIPTION OF THE DRAWINGS

DETAILED DESCRIPTION OF THE INVENTION

Figure 1:
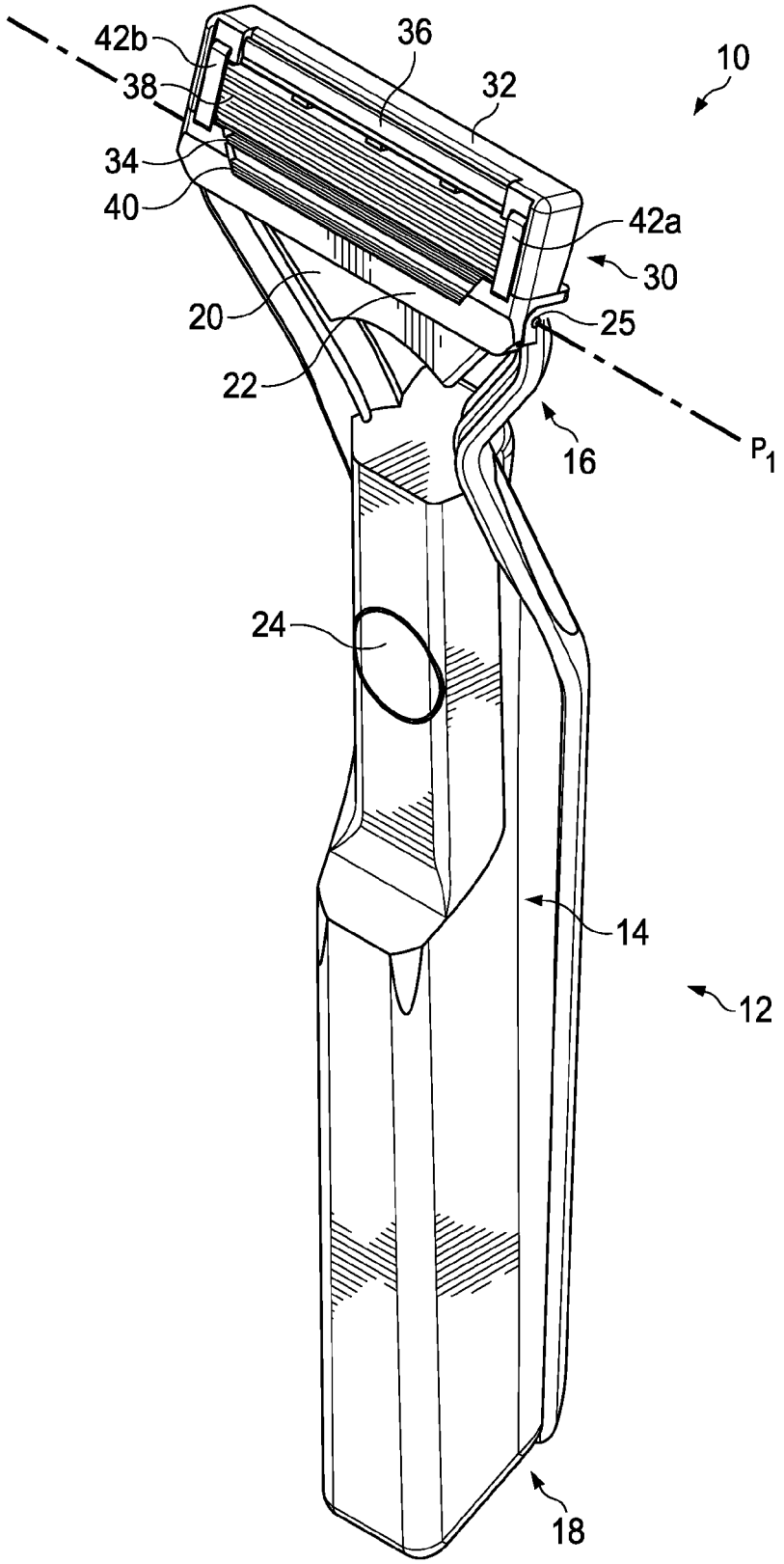
FIG. 1 is a perspective view of a shaving razor system.

Referring to FIG. 1, a perspective view of a shaving razor system 10 is shown. The shaving razor system 10 may include a handle 12 having an elongated gripping portion 14 with a proximal end 16 and a distal end 18. A connection base 20 may be mounted to the proximal end 16 of the handle 12. In certain embodiments, the connection base 20 may be pivotably mounted to the proximal end 16 of the handle 12 to allow movement about a pivot axis P1 generally transverse to the elongated gripping portion 14. A heater bar 22 may be joined to the connection base 20 of the handle 12 (i.e., the heater bar 22 cannot be removed under normal shaving conditions). Accordingly, the heater bar 22 may pivot relative to the handle 12. The heater bar 22 may be operably connected to a power source (e.g., a rechargeable battery, not shown) positioned within the handle 12 to provide a warming sensation during a shaving stroke. The handle 12 may have a switch 24 to control the operation of the heater bar 22.

The shaving razor system 10 may include a removable razor cartridge 30. The removable razor cartridge 30 may have a housing 32 with a guard 34, a cap 36 and one or more blades 38 mounted to the housing 32 between the cap 36 and the guard 34. The guard 34 and the cap 36 may define a shaving plane that is tangent to the guard 34 and the cap 36. The guard 34 may be a solid or segmented bar that extends generally parallel to the blades 38. In certain embodiments, the guard 34 may comprise a skin-engaging member 40 (e.g., a plurality of fins) in front of the blades 30 for stretching the skin during a shaving stroke. In certain embodiments, the skin-engaging member 40 may be insert injection molded or co-injection molded to the housing 32. However, other known assembly methods may also be used such as adhesives, ultrasonic welding, or mechanical fasteners. The skin engaging member 40 may be molded from a softer material (i.e., lower durometer hardness) than the housing 32. For example, the skin engaging member 40 may have a Shore A hardness of about 20, 30, or 40 to about 50, 60, or 70. The skin engaging member 40 may be made from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, skin engaging member 40 may comprise Kraiburg HTC 1028/96, HTC 8802/37, HTC 8802/34, or HTC 8802/11 (KRAIBURG TPE GmbH & Co. KG of Waldkraiburg, Germany). A softer material may enhance skin stretching, as well as provide a more pleasant tactile feel against the skin of the user during shaving. A softer material may also aid in masking the less pleasant feel of the harder material of the housing 32 and/or the fins against the skin of the user during shaving.

In certain embodiments, the blades 38 may be mounted to the housing 32 and secured by one or more clips 42*a* and 42*b*. Other assembly methods known to those skilled in the art may also be used to secure and/or mount the blades 38 to the housing 32 including, but not limited to, wire wrapping, cold forming, hot staking, insert molding, ultrasonic welding, and adhesives. The clips 42*a* and 42*b* may comprise a metal, such as aluminum for conducting heat and acting as a sacrificial anode to help prevent corrosion of the blades 38. Although five blades 38 are shown, the housing 32 may have more or fewer blades depending on the desired performance and cost of the removable razor cartridge 30. As will be described in greater detail below, once the blades 38 have become dulled (or damaged) the consumer may slidingly disengage the removable razor cartridge 30 from the connection base 20 and replace the used removable razor cartridge 30 with a new one. The removable razor cartridge 30 may slide onto and off the connection base 20 in a direction generally parallel to the elongated gripping portion 14 of the handle 12.

The cap 36 may be a separate molded (e.g., a shaving aid filled reservoir) or extruded component (e.g., an extruded lubrication strip) that is mounted to the housing 32. In certain embodiments, the cap 36 may be a plastic or metal bar to support the skin and define the shaving plane. The cap 36 may be molded or extruded from the same material as the housing 32 or may be molded or extruded from a more lubricious shaving aid composite that has one or more water-leachable shaving aid materials to provide increased comfort during shaving. The shaving aid composite may comprise a water-insoluble polymer and a skin-lubricating water-soluble polymer. Suitable water-insoluble polymers which may be used include, but are not limited to, polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, may have a high impact polystyrene (i.e., Polystyrene-butadiene), such as Mobil 4324 (Mobil Corporation).

Suitable skin lubricating water-soluble polymers may include polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Union Carbide Corporation) or ALKOX (available from Meisei Chemical Works, Kyota, Japan). These polyethylene oxides may have molecular weights of about 100,000 to 6 million, for example, about 300,000 to 5 million. The polyethylene oxide may comprise a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also contain up to about 10% by weight of a low molecular weight (i.e., MW<10,000) polyethylene glycol such as PEG-100.

The shaving aid composite may also optionally include an inclusion complex of a skin-soothing agent with a cylcodextrin, low molecular weight water-soluble release enhancing agents such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, moisturizers, cooling agents, etc.

Figure 2A:
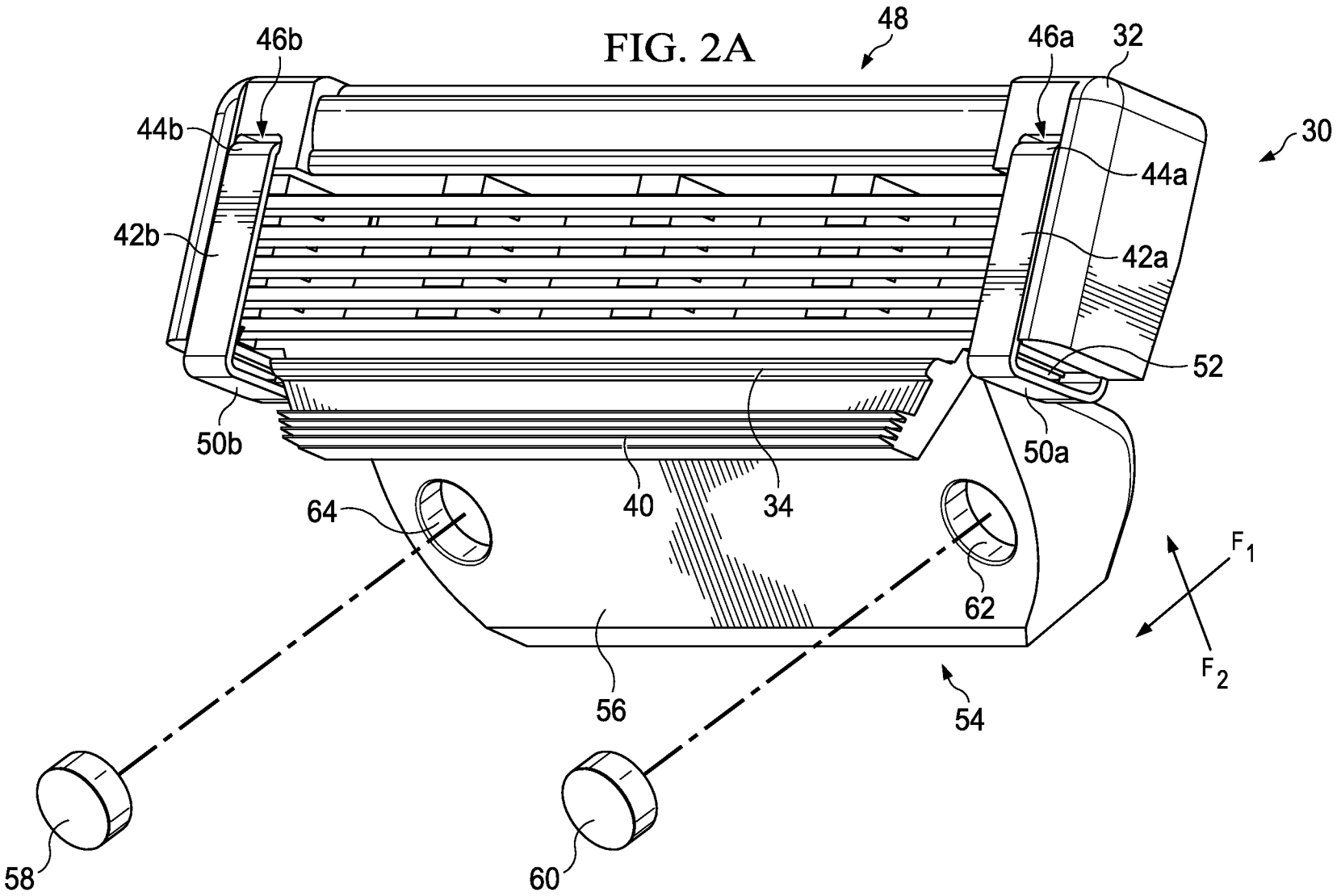
FIG. 2A is a front perspective view of a removable shaving razor cartridge that may be incorporated into the shaving razor system of FIG. 1.

Referring to FIG. 2A, a front perspective view of the removable shaving razor cartridge 30 of FIG. 1 is illustrated. A first end 44*a* and 44*b* of each clip 42*a* and 42*b* may extend through a respective first aperture 46*a* and 46*b* at a rear 48 of the housing 32. A second end 50*a* and 50*b* of each clip 42*a* and 42*b* may wrap around a front face 52 of the housing to secure the blades 38 in place. As will be described in greater detail below, inserting the clips 42*a* and 42*b* into the apertures 46*a* and 46*b* may increase the securement strength of the clips 42*a* and 42*b* to the housing 32, while wrapping the clips 42*a* and 42*b* around the front face 52 of the housing 32 may improve heat transfer from the heater bar 22 to the clips 42*a* and 42*b*. Accordingly, heat may be applied to a larger surface area of the removable shaving razor cartridge 30. The skin-engaging member 40 and/or the guard 34 may extend beyond the front face 52 of the housing 32 and/or the clips 42*a* and 42*b*.

The housing 32 may have an interconnect member 54 for attaching the removable shaving razor cartridge 30 to the handle 12, as shown in FIG. 1. The interconnect member 52 may have a handle mounting surface 56 for engaging a corresponding surface on the connection base of the handle 12. The handle mounting surface 56 may have at least one magnetic element 58 and 60. The handle mounting surface 56 may define at least one pocket 62 and 64 with the magnet element 58 and 60 mounted within the corresponding pocket 62 and 64. The handle mounting surface 56 may have an elongated pocket with a single magnetic element or a pair of smaller spaced apart pockets for holding corresponding magnetic elements. A direction of the force F1 exerted by the magnetic element(s) 58 and 60 may be generally transverse to a force F2 applied to remove and attach the removable shaving razor cartridge 30. Accordingly, the attachment and removal forces of the removable shaving razor cartridge 30 can be reduced for consumer ease of use (compared to a magnetic force that is exerted in a direction parallel to the removal force). In addition, the force to attach and/or remove the cartridge may be more gradual. For example, a more sudden and larger force may be required if the force exerted by the magnetic elements are in a parallel direction as the attachment/removal force.

Figure 2B:
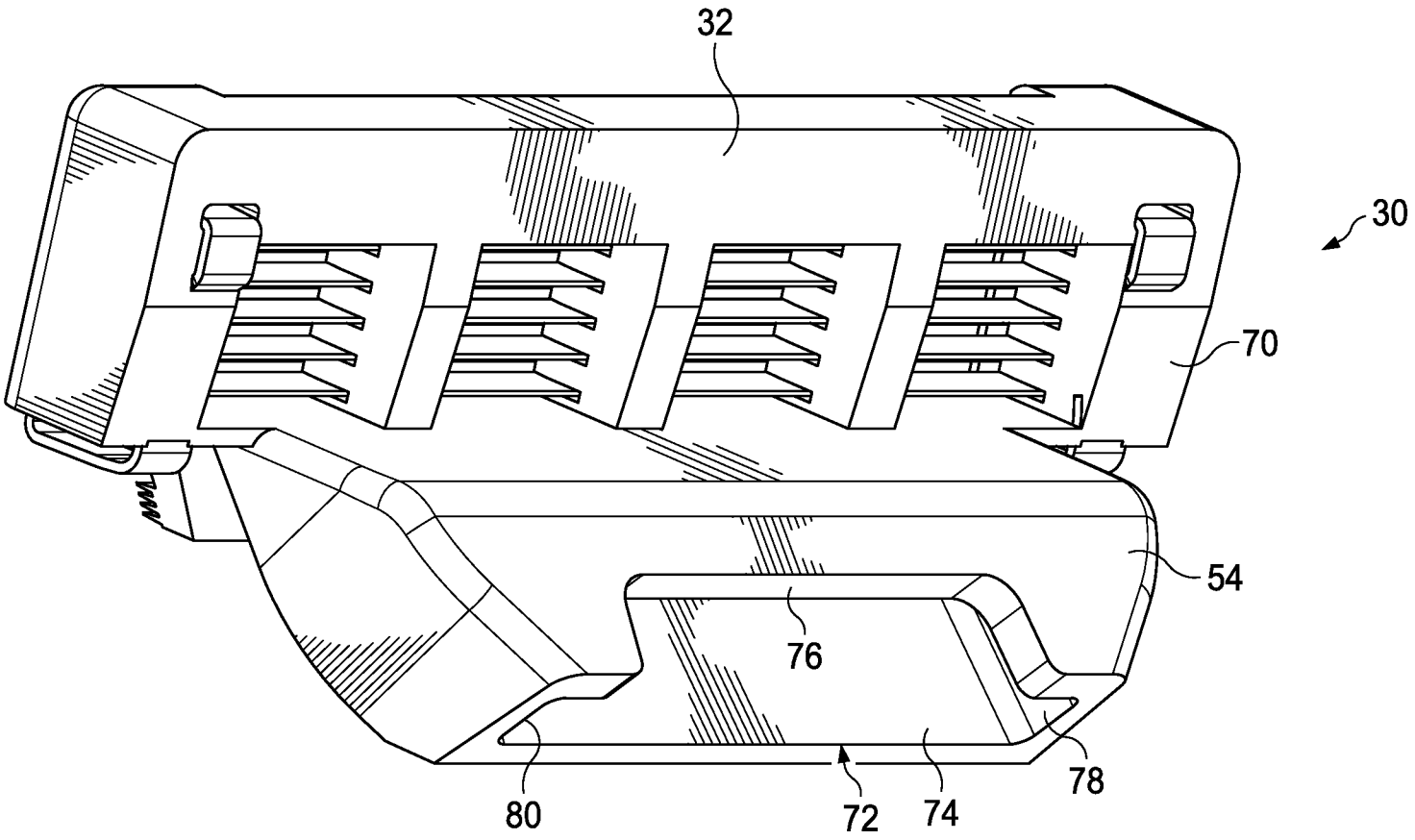
FIG. 2B is a rear perspective view of the removable shaving razor cartridge of FIG. 2A.

Referring to FIG. 2B, a rear perspective view of the removable shaving razor cartridge 30 of FIG. 2A is shown. In certain embodiments, the interconnect member 54 may be part of the housing 32. However, the interconnect member 54 may also be separately mounted or joined to the housing 32. The interconnect member 54 may extend out from a bottom surface 70 of the housing 32. An opening 72 may be defined by the interconnect member 54 for mating with a corresponding feature on the connection base 20 of the handle 12. The interconnect member 54 may have an internal front, rear and opposing sidewalls (74, 76, 78 and 80 respectively) defining the opening 72. In certain embodiments, the internal walls 74, 76, 78 and 80 may be smooth. For example, the internal walls 74, 76, 78 and 80 may not have any latch mechanisms or features to secure the interconnect member to the connection base. Such latch mechanisms may not be necessary because of the magnetic elements 58 and 60 used to secure the removable shaving cartridge 30 to the handle during shaving. In certain embodiments, the opening 72 may provide for proper alignment of the interconnect member 54 with the connection base 20 and proper alignment of the magnetic elements 60 and 58 with one or more corresponding magnetic elements on the connection base.

Figure 3:
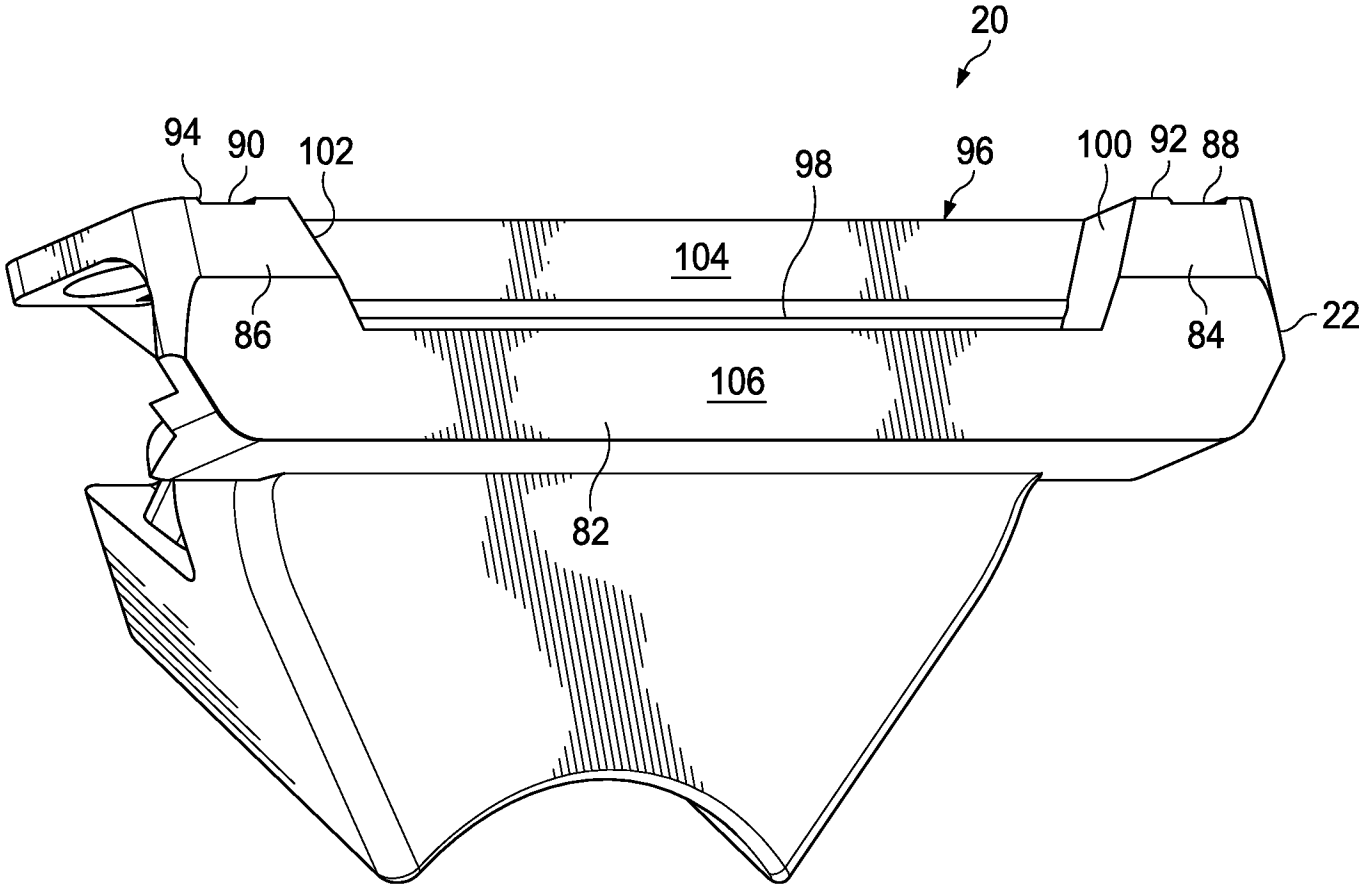
FIG. 3 is a front perspective view of a connection base that may be incorporated into the shaving razor system of FIG. 1.

Referring to FIG. 3, a front perspective view of the connection base 20 is illustrated. The heater bar 22 of the connection base 20 may have an elongated portion 82 that extends generally parallel to the blades 38 (e.g., transverse to the elongated gripping portion 14 of the handle 12), as shown in FIG. 1. A pair of lateral end portions 84 and 86 may extend from the elongated portion 82 in a direction generally transverse to the blades 38 (e.g., toward the blades 38 and/or away from the gripping portion 14 of the handle 12). Each lateral end portion 84 and 86 may have a respective notch 88 and 90. For example, the notches 88 and 90 may be located on respective rear end wall 92 and 94 of the lateral end portions 84 and 86. The notches 88 and 90 may be dimensioned to receive at least a portion of the respective clips 42*a* and 42*b*. The heater bar 22 may define a recess 96 dimensioned to receive and/or support at least a portion of the housing 32 (e.g., the skin-contacting member 40). The recess 96 may be defined by a rear wall 98 of the elongated portion 82 and a side wall 100 and 102 of each of the lateral end portions 84 and 86 of the heater bar 22. The heater bar 22 may also have a recessed surface 104 (i.e., bottom wall connecting the front wall and side walls) that is positioned below and behind and below a skin contacting surface 106 of the heater bar 22. The recessed surface may support at least a portion of the housing (e.g., the skin-contacting member 40).

Figure 4:
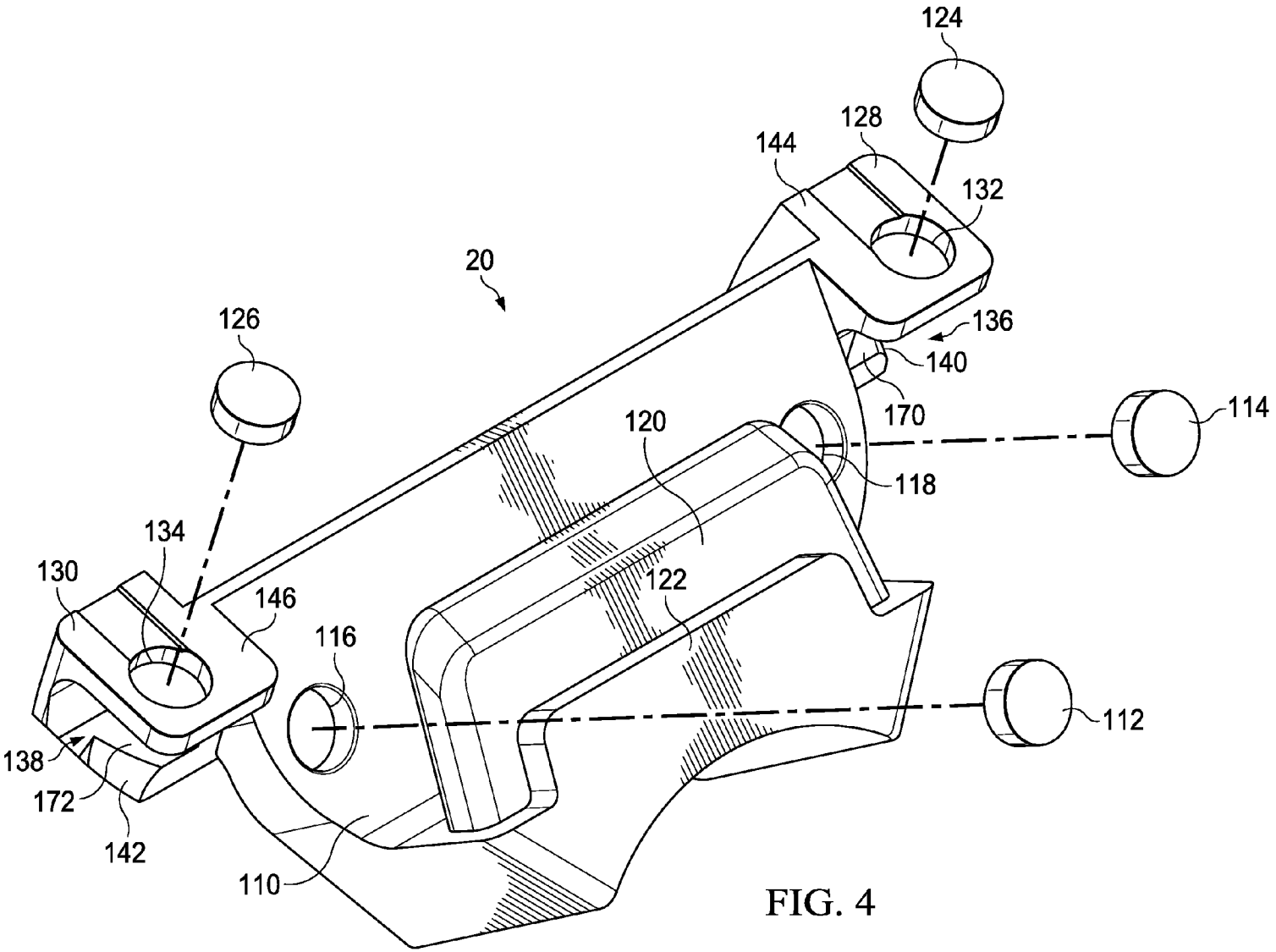
FIG. 4 is a rear perspective assembly view of the connection base of FIG. 3.

Referring to FIG. 4, a rear perspective assembly view of the connection base 20 of FIG. 3 is shown. The connection base 20 may have a housing mounting surface 110 that corresponds with the handle mounting surface 56 on the removable razor cartridge 30. The housing mounting surface 110 may have at least one magnetic element 112 and 114 that engages the corresponding magnetic element 60 and 58 of the handle mounting surface 56 of FIG. 2A. For example, the housing mounting surface 110 may have an elongated pocket with a single magnetic element or a pair of smaller spaced apart pockets 116 and 118 for holding the corresponding magnetic elements 112 and 114 (as shown). The connection base 20 may have an intermediate wall 120 spaced apart from the housing mounting surface 110 and a front wall 122 of the connection base 120. The intermediate wall 120 may be dimensioned to mate with the opening 72 of the interconnect member 54 on the housing 32.

The connection base 20 may have at least one biasing magnetic element 124 and 126 for providing a pivot return force. For example, the connection base 20 may have a pair of spaced apart tabs 128 and 130 each defining a pocket 132 and 134 dimensioned to receive the biasing magnetic element. As will be described in greater detail below, the biasing magnetic element(s) 124 and 126 of the connection base 20 may repel a corresponding biasing magnetic element on the handle 12. Each of the tab 128 and 130 members may define an opening 136 and 138 dimensioned to receive a corresponding feature of the handle 12. Each opening 136 and 138 may extend into a respective side end wall 140 and 142 of the corresponding tab members 128 and 130. The end walls 140 and 142 may be generally transverse to a top wall 144 and 146 that defines the respective pockets 134 and 132 for the magnetic elements 126 and 124.

Figure 5A:
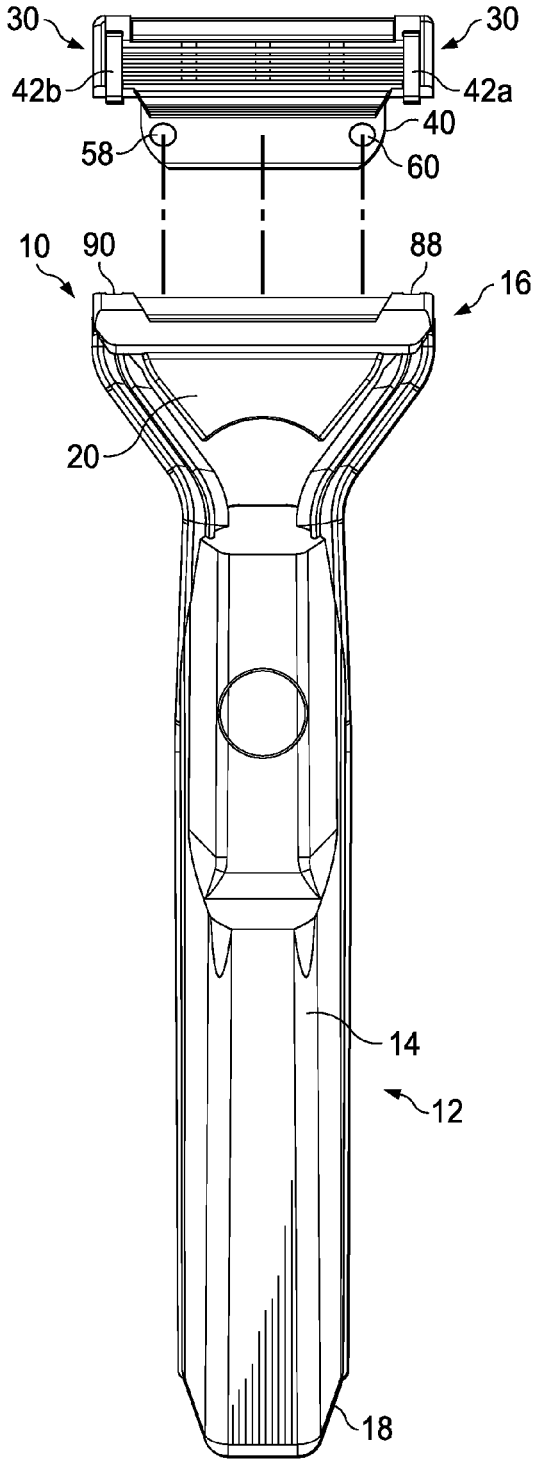
FIG. 5A is a front perspective assembly view of the shaving razor system of FIG. 1.
Figure 5B:
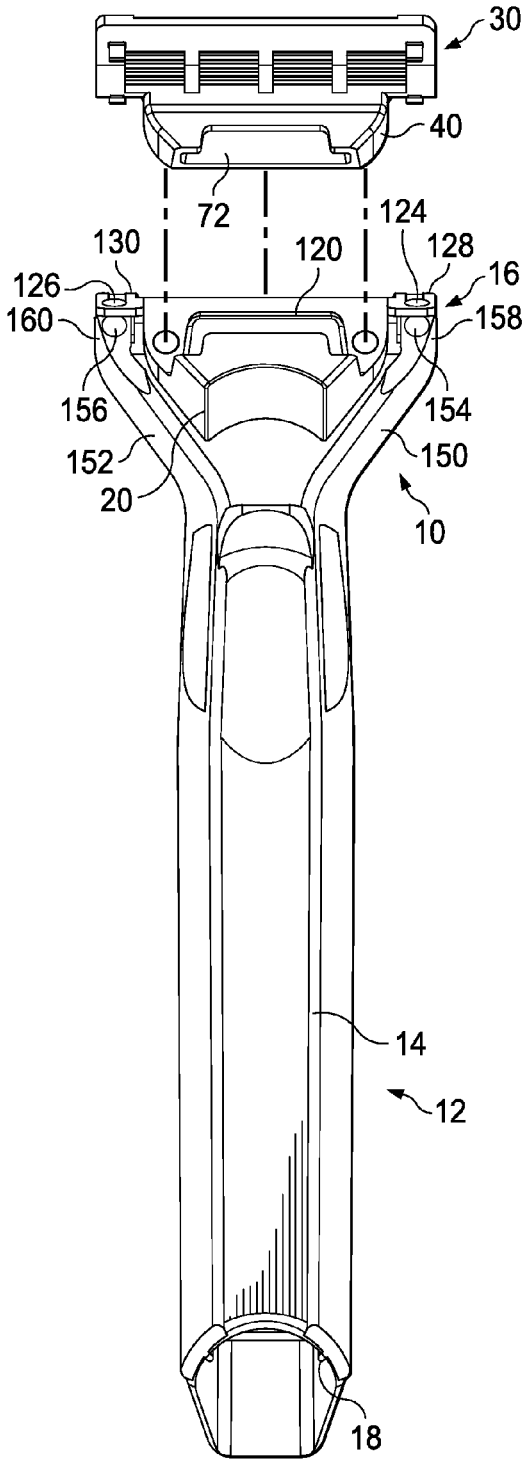
FIG. 5B is a rear perspective assembly view of the shaving razor system of FIG. 1.

Referring to FIGS. 5A and 5B a front perspective assembly view and a rear perspective assembly view of the shaving razor system 10 of FIG. 1 are shown, respectively. As shown in FIG. 5A, the connection base 20 may pivot relative to the proximal end 16 of the handle 12. The proximal end 16 of the handle 12 may have a pair of spaced apart arms 150 and 152. Each arm 150 and 152 may have a biasing magnetic element 154 and 156 that repels the corresponding biasing magnetic element 124 and 126 of the tab members 128 and 130. An end 158 and 160 of each arm 150 and 152 may be positioned within the respective opening 136 and 138 of the tab members 128 and 130. Accordingly, the end 158 and 160 of each arm 150 and 152 may pivot within the corresponding opening 136 and 138 between the top wall 144 and 146 and a bottom wall 170 and 172 of the corresponding tabs 128 and 130. The top walls 144 and 146 and bottom walls 170 and 172 may also act as stop surfaces to prevent over pivoting. In a rest position, the end 158 and 160 of each arm 150 and 152 may be spaced away from the respective top walls 144 and 146 because of the repelling forces generated by the corresponding biasing magnetic elements (e.g., the biasing magnetic element 154 repels the biasing magnetic element 124; and the biasing magnetic element 156 repels the biasing magnetic element 126).

The removable razor cartridge 30 may be attached to the handle 12 by engaging the interconnect member 54 with the connection base 20. The intermediate wall 120 of the connection base 20 may be received by the opening 72 of the interconnect member 54. The handle mounting surface 56 may engage the housing mounting surface 110 of the connection base 20 to temporarily secure the removable razor cartridge 30 to the connection base 20. The magnetic elements 112 and 114 may be aligned with and magnetically attracted to the corresponding opposing magnetic elements 58 and 60. The direction of the force between the opposing magnetic elements (e.g., between magnetic element 112 and magnetic element 58) may be generally transverse to the force required to remove and attach the interconnect member 54 with the connection base 20 (e.g., which may be generally parallel to the elongated gripping portion 14 of the handle 12).

Figure 6:
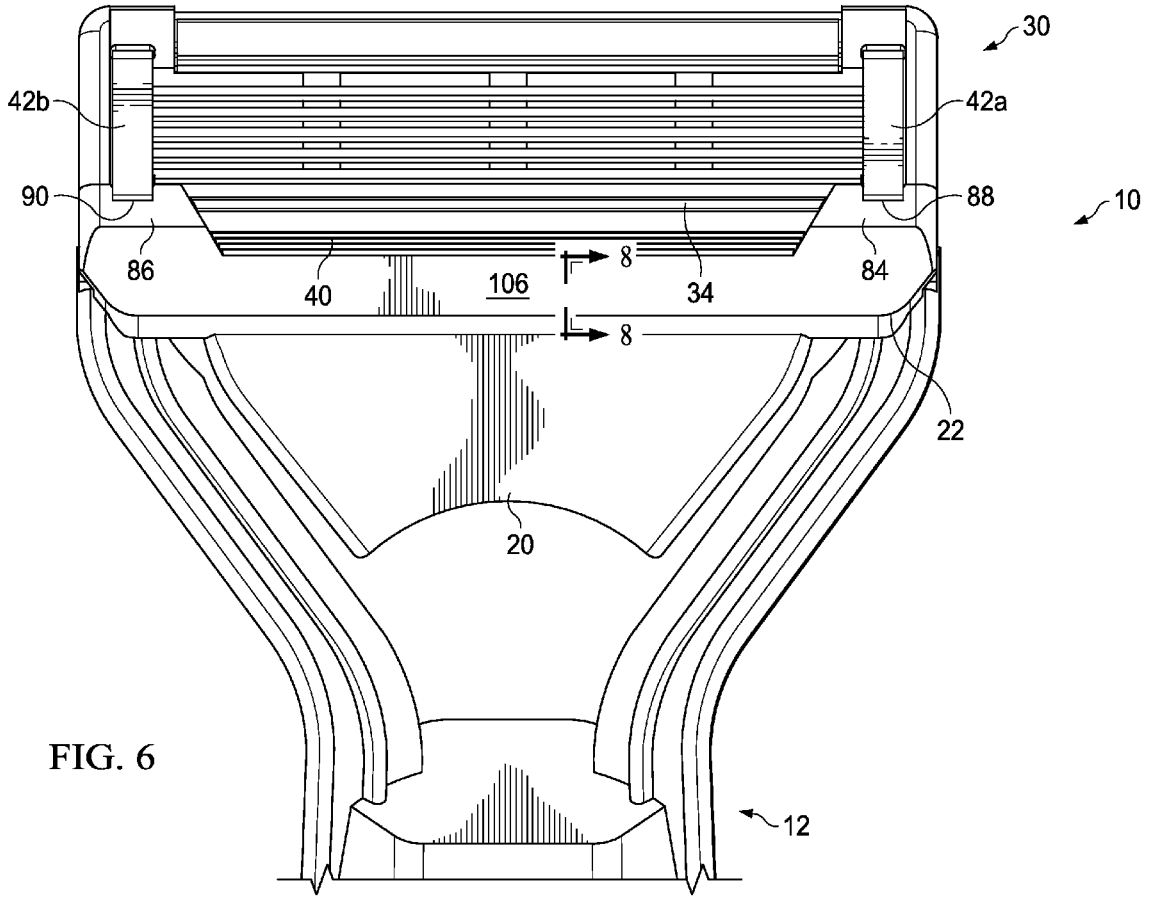
FIG. 6 is an enlarged front view of the shaving razor system of FIG. 1.

FIG. 6 is an enlarged front view of the shaving razor system 10 of FIG. 1 with the removable razor cartridge 30 secured to the handle 12 (via the connection base 20). As shown in FIG. 6, the skin engaging member 40 and/or the guard 34 may be positioned between the lateral end portions 84 and 86 of the heater bar 22. In addition, the clips 42*a* and 42*b* may be positioned within the respective notches 86 and 84 of the heater bar 22. The clips 42*a* and 42*b* may comprise a metal (such as aluminum) having good thermal conduction properties. The notches 88 and 90 may facilitate the transfer of heat to the clips 42*a* and 42*b* (e.g., the heater bar 22 may contact the clips 42*a* and 42*b* through the notches 88 and 90). Accordingly, heat may be transferred not only just in front of the blades 38, but also on both sides of the blades 38 and the skin engaging member 40 and/or the guard 34. Furthermore, since the blades 38 comprise metal (e.g., steel) and contact the clips, heat is also transferred from the metallic clips 42*a* and 42*b* to the blades 38 optimizing the amount of heat transferred to the skin's surface during a shaving stroke. The skin contacting surface 106 of the heater bar 22 is shown positioned substantially adjacent to the skin engaging member 40 and/or the guard 34. Accordingly, the skin contacting surface 106 of the heater bar 22, the skin engaging member 40 and/or the guard 34 may all be contacted by the user's skin during a shaving stroke (e.g., on the same plane).

Figure 7:
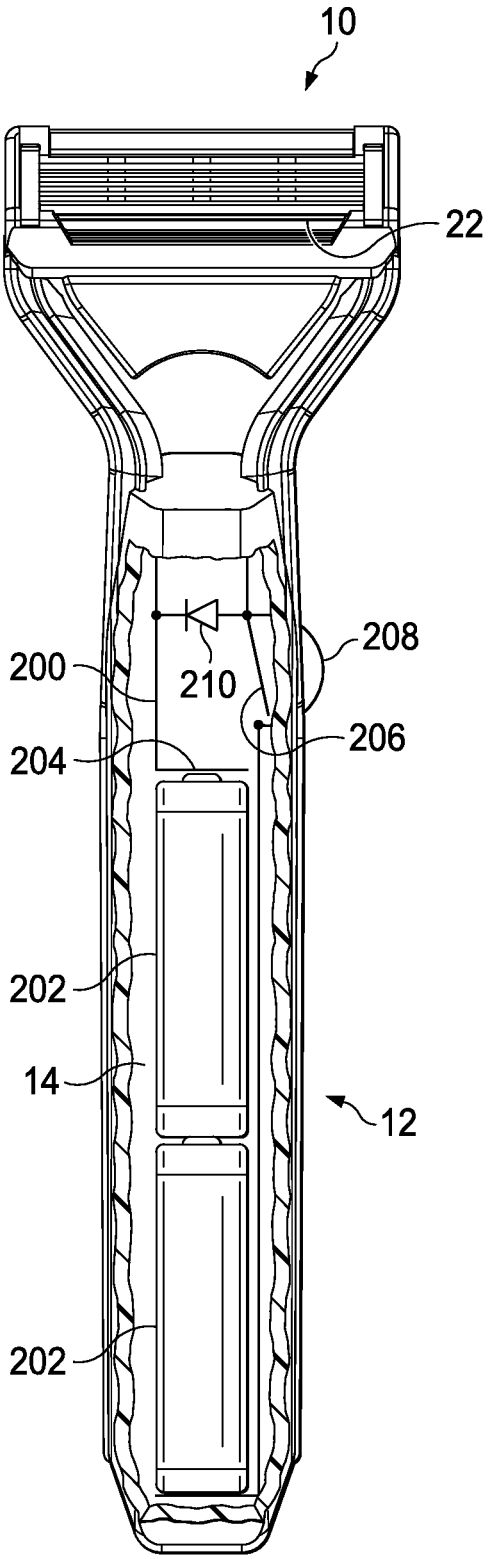
FIG. 7 is diagrammatic front view of a razor of FIG. 1.
Figure 8:
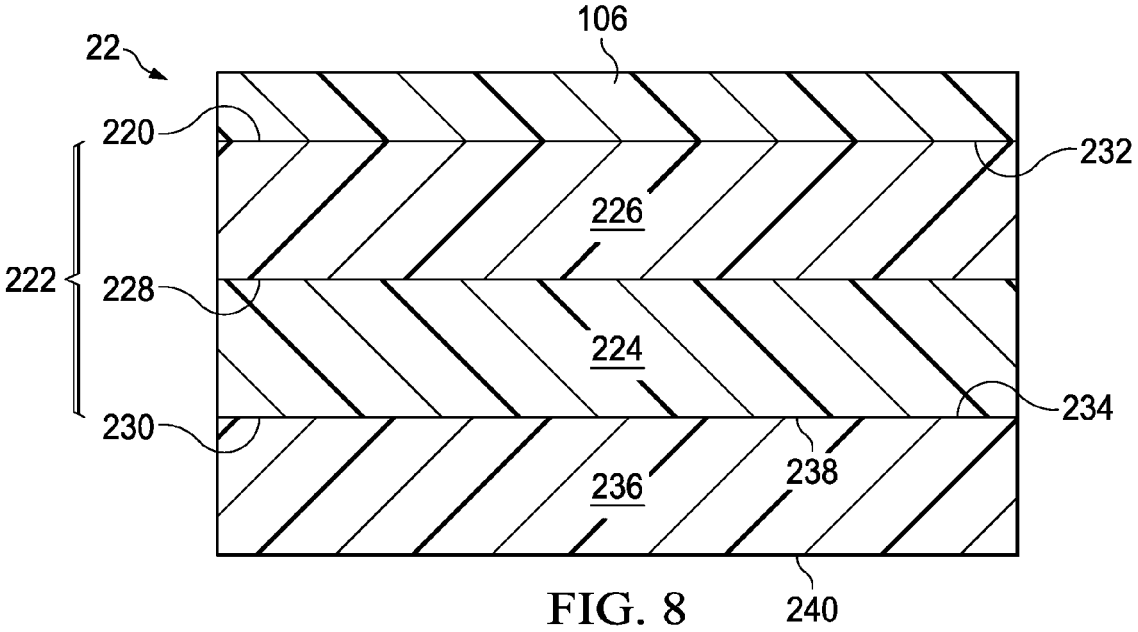
FIG. 8 is a cross-sectional view of the razor cartridge of a heater bar of the shaving razor system taken along line 8-8 of FIG. 6.

Referring to FIG. 7, the shaving razor system 10 may include an electrical circuit 200 to which current is supplied by a power source 202 (e.g., such as one or more disposable or rechargeable batteries) through a contact 204. The power source 202 may be positioned within handle 12 (e.g., elongated gripping portion 14). The electrical circuit 200 is closed by a switch 206, which may be actuated by the user by pushing button 208. An LED 210 is provided on handle 12 to indicate to the user that the power has been turned on or off. The LED 210 may be disposed in a transparent area of the handle 12 or may extend through an opening in the handle 12. The LED 210 may be positioned in an area of the handle 12 other than that shown in FIG. 7, or may be omitted. The LED 210 may indicate whether the heater bar 22 is warm or warming, whether the heater bar 22 is too hot and other properties of the shaving razor system 10.

The heater bar 22 may comprise any material that is effective in dissipating heat. A suitable material for the heater bar 22 is a metal such as aluminum, copper, gold, steel, brass, nickel and alloys thereof with aluminum being the preferred metal. Other materials having heat dissipating properties similar to those of the metals listed may also be used. The heater bar 22 may be coated or textured to provide an improved user experience as it may come into direct contact with the user's skin during shaving. For example, the heater bar 22 may be textured with small protuberances or bumps and coated with a polymer composition such as a polyfluorocarbon.

The heater bar 22 comprises the skin contacting surface 106 and a lower or second surface 220 opposed to the skin contacting surface 106. A heating element 222 is positioned below the second surface 220 of the heater bar 22. The heating element 222 may comprise a resistive member 224 and an insulating member 226. The resistive member 224 has a first surface 228 and an opposed second surface 230. The insulating member 226 may have a first surface 232 and an opposed second surface 234. The first surface 232 of the insulating member 226 is joined to the second surface 220 of the heater bar 22. The second surface 234 of the insulating member 226 is joined to the first surface 228 of the resistive member 224.

The heating element 222 may comprise a second insulating member 236. The second insulating member 236 may have a first surface 238 and an opposed second surface 240. The first surface 238 of the second insulating member 236 may be joined to the second surface 230 of the resistive member 224.

The resistive member 224 may have a first end and an opposed second end. Electrical contacts may be provided at each end and, respectively, of resistive member 46. The electrical contacts may comprise silver. Other conductive materials such as aluminum, copper, gold, steel, brass, nickel, and alloys thereof may be used for electrical contacts. Current leads are secured to electrical contacts, to form part of an electrical circuit which is configured to deliver energy to the resistive member 224 to heat the resistive member 224. The resistive member 224 of heating element 222 delivers heat to the heater bar 22 which is dissipated over the upper or skin contacting surface 106 of the heater bar 22 to provide warmth to the user's skin during shaving.

The insulating member 226 may be comprised of glass, glass-ceramic, ceramic, oxides, or any other dielectric materials. The resistive member 224 may be comprised of a sol-gel solution filled with a conductive powder. A coating may be formed by mixing a sol-gel solution with up to about 90% by weight of the solution of a conductive powder to provide a uniform stable dispersion. Suitable resistive members are disclosed in WO 02/072495 A2. The resistive member may also be constructed of nickel chromium, gold, steel and other materials. The resistive member preferably has a resistance of from about 0.1 to about 100 Ohm, more preferably from about 0.5 to about 20 Ohm, and most preferably 2 Ohm. The second insulating member 236 may be comprised of glass, glass-ceramic, ceramic, oxides or any other dielectric materials. The resistive member(s) may be joined to the insulating members by a sol-gel process, spraying, dipping, spinning, brushing, printing, sputtering, gluing or other suitable techniques. The resistive member 224 may heat up sufficiently to heat the skin contacting surface 106 of the heater bar 22 to about 30° C. to about 70° C.

It is understood that magnetic elements 58, 60, 112 and 114 (i.e., exert an attractive force, not a repelling force) described herein may be an element that either exerts an attractive force or an element that is attracted by a magnetic force. For example, the magnetic element(s) of the handle mounting surface may be a material that attracts metal and the magnetic element(s) of the housing mounting surface may comprise a metallic material that is attracted by the magnetic element(s) of the handle mounting surface. In certain embodiments, the magnetic elements of both the handle mounting surface and the housing mounting surface may exert a magnetic force for improved engagement. Any of the magnetic elements described herein may include ceramic magnets, alnico magnets, samarium cobalt magnets, neodymium iron boron magnets, electromagnets, or any combination thereof. Furthermore, any of the magnetic elements described herein may also be plated or coated (e.g., with plastic, rubber or nickel) to resist corrosion caused by the shaving environment.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor system comprising:

a handle having an elongated gripping portion with a proximal end portion and a distal end portion, a connection base mounted to the proximal end portion of the handle, a heater bar operably connected to a power source positioned within the handle, the heater bar being joined to the connection base;

a removable razor cartridge having a housing with a guard, a cap and at least one blade mounted to the housing between the guard and the cap, an interconnect member fixed to the housing having a handle mounting surface releasably engaged with a corresponding surface on the connection base; and the interconnect member is rigidly fixed to the housing and the connection base is pivotably mounted to the proximal end portion of the handle wherein the heater bar has an elongated portion extending generally parallel to the blade and a pair of opposing lateral end portions that extend generally transverse from the elongated portion toward the blade and each lateral end portion has a respective notch dimensioned to receive at least a portion of a clip on the housing.

2. The shaving razor system of claim 1 wherein the connection base is pivotably mounted to the proximal end of the handle to allow movement about a pivot axis that is generally transverse to the elongated gripping portion.

3. The shaving razor system of claim 1 wherein the guard comprises a skin-engaging member.

4. The shaving razor system of claim 3 wherein the skin engaging member comprises an elastomeric material.

5. The shaving razor system of claim 1 wherein the interconnect member defines an opening dimensioned to receive an engagement member on the connection base.

6. The shaving razor system of claim 1 wherein the connection base has a recessed surface that supports at least a portion of the housing.

7. The shaving razor system of claim 6 wherein the guard comprises an elastomeric skin-engaging member and the recessed surface supports the skin engaging member.

8. The shaving razor system of claim 7 wherein at least a portion of the skin engaging member is positioned between a pair of opposing lateral end portions of the heater bar.

9. The shaving razor system of claim 1 wherein the heater bar has a recessed surface behind the elongated portion.

10. The shaving razor system of claim 9 wherein the recessed surface supports the guard.

* * * * *